US005387285A

United States Patent [19]

Rivers

[11] Patent Number: 5,387,285

[45] Date of Patent: Feb. 7, 1995

[54] APPARATUS FOR INJECTING A FLUID INTO FILTER TOW

[75] Inventor: Ernest E. Rivers, Pfafftown, N.C.

[73] Assignee: R. J. Reynolds Tabacco Company, Winston-Salem, N.C.

[21] Appl. No.: 892,082

[22] Filed: Jun. 2, 1992

[51] Int. Cl.[6] ..... B05B 7/00

[52] U.S. Cl. ..... 118/325; 239/338; 493/44; 493/49

[58] Field of Search ..... 118/317, 325; 264/555; 425/186, 191, 387.1; 493/43, 44, 49; 156/180; 239/338

[56] References Cited

U.S. PATENT DOCUMENTS

| | | | |
|---|---|---|---|
| 2,736,534 | 2/1956 | Atkins | 425/191 |
| 3,546,743 | 12/1970 | Roth | 425/191 |
| 3,637,447 | 1/1972 | Berger et al. | 493/44 |
| 3,847,064 | 11/1974 | Berger | 493/44 |
| 4,355,995 | 10/1982 | Berger | 493/44 |
| 4,409,995 | 10/1983 | Nichols . | |
| 4,472,224 | 9/1984 | Pryor | 156/180 |
| 4,476,807 | 10/1984 | Pryor | 118/317 |
| 4,522,616 | 6/1985 | Hyde et al. | 493/44 |
| 4,525,385 | 6/1985 | Pryor | 427/177 |
| 4,549,875 | 10/1985 | Pryor | 493/49 |
| 4,768,526 | 9/1988 | Pryor | 131/335 |
| 4,850,301 | 7/1989 | Green, Jr. et al. | 118/255 |
| 4,899,765 | 2/1990 | Davis et al. | 131/84.1 |
| 5,106,357 | 4/1992 | Kampen | 493/44 |

FOREIGN PATENT DOCUMENTS

| | | |
|---|---|---|
| 172654 | 2/1986 | European Pat. Off. . |
| 0213833 | 3/1987 | European Pat. Off. . |
| 269915 | 6/1988 | European Pat. Off. . |
| 2229079 | 9/1990 | United Kingdom . |

*Primary Examiner*—Mathieu D. Vargot

*Attorney, Agent, or Firm*—Grover M. Myers; George C. Myers, Jr.

[57] ABSTRACT

A fluid injection device and method of injecting and distributing a fluid, such as a gas, liquid or combination thereof, to a continuous, multifilament filter tow used in the manufacture of filters for smokable tobacco products. The injection device includes a converging tongue portion from which a nozzle block is suspended and rigidly supported. A nozzle conduit with a plurality of feed holes is formed in the nozzle block for delivering the fluid to a precise location in the advancing filter tow during its formation and consolidation into a filter rod. Additives, such as flavorants, may be injected into the tow or the tow may be further bloomed by a gas, such as air, to decrease tow usage.

17 Claims, 2 Drawing Sheets

APPARATUS FOR INJECTING A FLUID INTO FILTER TOW

FIELD OF THE INVENTION

The present invention relates to the manufacture of tobacco smoke filters, and more particularly to a method of and an apparatus for uniformly and precisely injecting and distributing fluids into a multifilament filter tow used in the manufacture of tobacco smoke filters.

BACKGROUND OF THE INVENTION

It is desirable to inject and distribute various fluids to the multifilament filter tow used in the manufacture of tobacco smoke filters. These fluids, which are injected and distributed to the tow alone or in combination with liquid or gaseous carriers, may be flavorants, tow blooming agents, lubricants, sizing solutions, finish compositions, plasticizers, or the like, and are intended to impart desired physical or flavor characteristics to the fluid-treated tow.

Tobacco smoke filters are typically manufactured from cellulose acetate filaments which are formed into a multifilament rope or tow. The tow is treated with various consolidating additives and compressed or condensed into a continuous filter rod and, subsequently, is cut to a desired length. As is well known in the art, the cut filter rod is then assembled in coaxial relationship with a suitable cut section of a rod of tobacco filler. The assembly is then wrapped with a suitable paper or fiber wrapping to form a complete smokable product in the form of, for example, a cigarette, cigarillo, or cigar.

The addition of one or more additives to the tobacco smoke filter, such as flavorants and the like, enhances the flavor or other characteristics of the smoke as it is drawn therethrough by the user. One method of maximizing this enhancement is by selectively distributing the additive through the filter tow such that the additive is distributed at a predetermined location relative to the longitudinal axis of the tow. In general, it is desirable to uniformly distribute the additive along the central or longitudinal axis of the filter tow. Uneven or eccentric distribution of a flavorant additive can result in an inconsistent and undesirable tobacco smoke taste.

Various approaches have been used to distribute additives in a continuous multifilament filter tow. U.S. Pat. No. 4,549,875, assigned to the assignee of this invention, discloses one such approach and the disclosure thereof is incorporated herein by reference. In that patent, a conventional rod-making apparatus is disclosed which has been modified for injecting an additive into the filter tow in a tongue device located downstream of a converging horn. A conduit mounted in cantilevered fashion to the horn extends into the tongue device and terminates in a nozzle disposed coaxially in the filter tow path. An additive flowed under pressure into the conduit is distributed through a plurality of orifices disposed in the nozzle.

Because the cantilevered conduit and nozzle extend a significant distance from the converging horn mounting into the filter tow path, it is sometimes difficult to initially position the nozzle coaxially on the tow path axis and to precisely maintain the nozzle in that position because of forces created by the advancing filter tow as it passes around the conduit and nozzle. A minor deviation in the position of the conduit at its mounting point on the horn may result in a major deviation of the nozzle relative to the longitudinal axis of the advancing tow. Such deviation will result in asymmetric and inconsistent additive distribution to the filter tow.

Variations in the speed and supply volume of the filter tow as well as machine vibration may also adversely affect the positional stability of the cantilevered conduit and nozzle. Given these conditions, the conduit and nozzle must be frequently checked for proper positioning and repositioned in a trial-and-error fashion, resulting in considerable production down time, as well as uncertainty that the additive is properly distributed in the finished product, especially in the usual case where the additive is a colorless liquid. Furthermore, the nozzle must be repositioned for each filter tow run, especially when successive tow runs are of different tow composition, density, cross-section, or speed.

U.S. Pat. Nos. 4,476,807 and 4,850,301, also assigned to the assignee of this invention, disclose other apparatus for applying an additive to a filter tow upstream of the rod-forming converging horn and tongue device of the filter making machine. In U.S. Pat. No. 4,476,807, for example, the additive is introduced into the tow in the filter tow blooming jet apparatus and in U.S. Pat. No. 4,476,807, a plasticizer additive is introduced to a thin flattened band of tow by a perforated roll applicator disposed upstream of the blooming jet apparatus. While such apparatus are very effective for distributing an additive, such as a plasticizer, uniformly throughout the filter tow, they are not as effective in concentrating an additive along the axis of the finished filter rod as is particularly desirable in the case of a flavorant additive.

It is also known to inject a gaseous fluid, such as air, into a tow as it travels through a converging and consolidating tongue device for the purpose of slightly blooming the tow and thereby reducing the total volume of tow necessary to manufacture a given length of filter rod product. It will be appreciated that even a small reduction in the total volume of tow used in the manufacture of a given number of filter cigarettes, will amount to substantial savings in manufacturing costs for those cigarettes. In the known construction, air is injected from a manifold through a series of holes formed in the upper portion of the converging wall of the tongue device. It has been found, however, that this construction is not particularly effective in blooming the tow and is clearly incapable of injecting an additive along the longitudinal axis of the tow.

In view of the foregoing, it would be desirable to provide an apparatus for injecting a fluid, including gases, liquids and combinations thereof, into a multifilament filter tow which is not subject to the positioning difficulties and other limitations of the prior art devices. Such an apparatus would be particularly useful for the purpose of concentrating an additive precisely along the longitudinal axis of the tow or for effectively providing additional blooming of a filter tow to reduce the total volume of tow used in filter cigarette manufacture.

SUMMARY OF THE INVENTION

It is therefore an object of the present invention to provide a method of and an apparatus for uniformly and accurately injecting and distributing a fluid along the longitudinal axis of an advancing, continuous, multifilament filter tow used in conjunction with the manufacture of smokable tobacco products, such as cigarettes.

It is another object of the present invention to provide an apparatus for injecting a fluid into a multifilament filter tow which is not subject to positional variations of the injector.

It is a further object of the present invention to provide an apparatus for injecting a fluid into a multifilament filter tow which is integrated with the filter rod-forming section of conventional filter rod-making machinery.

It is another object of the present invention to provide an apparatus for injecting an additive, such as a flavorant, precisely along the longitudinal axis of an advancing filter tow.

It is yet another object of this invention to provide a method of and an apparatus for injecting a gaseous fluid into the interior of a filter tow as it is converged and consolidated to further bloom the tow and thereby reduce the total volume of tow required for the manufacture of filter cigarettes.

The present invention comprises an apparatus for injecting and distributing any of a variety of fluids, including gases, liquids and combinations thereof known in the tobacco smoke filter art into a continuous, multifilament filter tow used in the manufacture of filters for smokable tobacco products. More particularly, the invention comprises a unique tongue injection device for delivering the fluid to the advancing filter tow during its final condensation and consolidation into a filter rod.

The tongue injection device is constructed in a manner similar to a conventional tongue device for converging and compressing the tow into the final, compact filter rod just before the rod is enveloped by a paper web in the garniture of the filter rod-making machine. According to this invention, a nozzle block integrally formed with or rigidly affixed to the tongue injection device extends into the converging throat of the tongue injection device such that it occupies a position along the longitudinal axis of a filter tow as the tow passes through the tongue injection device. The nozzle block is provided with a nozzle bore or conduit closed at both ends, the longitudinal axis of which is substantially coincident with the longitudinal axis of the throat of the tongue injection device, and thus, substantially coincident with the longitudinal axis of a filter tow passing therethrough. A plurality of feed holes is formed in the nozzle block and communicates with the nozzle conduit.

In a first embodiment, a pressurized additive, such as a flavorant, is supplied to the nozzle conduit by means of a passage connecting the conduit with an atomizer to which is introduced the additive and a pressurized gas. Because the nozzle block is disposed in a rigid, fixed relationship with respect to the throat of the tongue injection device, the additive injection system of the present invention is not subject to the limitations and inaccuracies of the prior art devices resulting from deviations of the nozzle from the longitudinal axis of the filter tow. To insure that the additive injected in the tongue injection device will be located precisely along the longitudinal axis or centerline of the finished filter rod, the feed holes of the nozzle are arranged in a spiral array about the lowermost rounded extremity of the nozzle conduit wall. The holes are equi-angularly spaced about the axis of the nozzle conduit and are spaced an equal axial distance from one another along the longitudinal axis of the nozzle conduit. Thus, when the filter tow is compressed and consolidated just downstream of the nozzle block, the flows of additive through the feed holes are likewise consolidated and positioned along and around the longitudinal axis of the filter tow.

In a second embodiment of the invention, a pressurized gas, such as air, is supplied to the nozzle conduit in the same manner as described above, except that no atomizer is necessary. Otherwise, the apparatus used in the first embodiment may also be used in the second embodiment. The pressurized gas is advantageously injected along the longitudinal axis of the tow radially outwardly through the multifilaments of the tow to separate and misalign the filaments of the tow and thereby bloom the tow slightly. It has been found that this process is effective to reduce tow usage and thus reduce the manufacturing costs of filter cigarettes.

With the foregoing and other objects, advantages, and features of the invention that will become hereinafter apparent, the nature of the invention may be more clearly understood by reference to the following detailed description of the invention, the appended claims, and to the several views illustrated in the drawings.

DETAILED DESCRIPTION OF THE INVENTION

Figure 1:
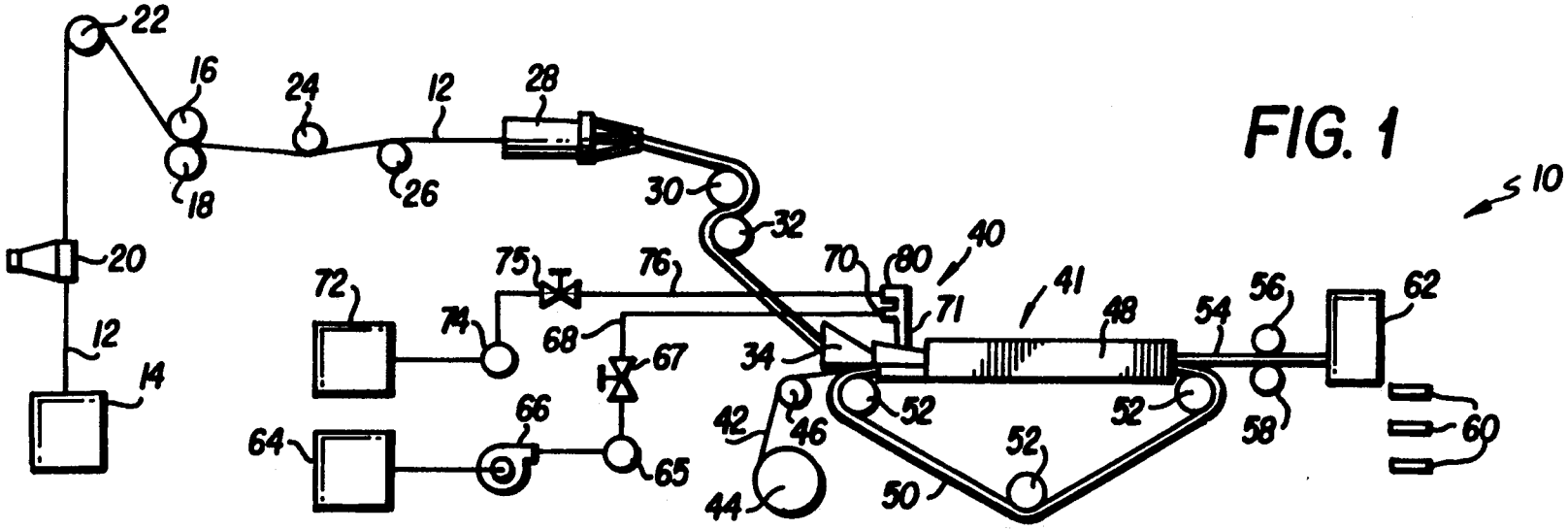
FIG. 1 is a schematic representation of an apparatus for injecting a fluid into a continuous, multifilament filter tow according to the present invention.

Referring now in detail to the drawings wherein like parts are designated by like reference numerals throughout, there is illustrated in FIG. 1 a schematic view of a continuous, multifilament filter rod-making apparatus which is designated generally by reference numeral 10. A continuous multifilament filter tow 12, such as a cellulose acetate tow, is drawn from a filter tow supply 14 by paired feed rolls 16, 18. The tow 12 is passed through a pneumatic banding jet 20 and over a guide roll 22 before reaching the feed rolls 16, 18. After being substantially flattened by the feed rolls 16, 18, the tow 12 is passed between a pair of wick-type plasticizer applicators 24, 26. The plasticized filter tow 12 is then passed through a blooming device 28 of conventional design which loosens and blooms the filter tow 12 by subjecting it to tension created by a rapidly moving stream of gas (not shown) thereby producing a longitudinally oriented assembly of filaments having individual filaments of the tow in substantial alignment. The plasticized and bloomed tow 12 is then advanced from the blooming device 28 by paired delivery rolls 30, 32 and directed to a converging horn 34 which converges the tow and feeds it to the tongue injection device 40 of the present invention where a fluid is injected into the tow as will be more fully described hereinafter.

Downstream of the tongue injection device 40, there is arranged the garniture 41 of the filter rod-making apparatus 10. The garniture 41 operates as follows. A continuous paper web 42 from a paper supply roll 44 passes over a guide roll 46 beneath the converging horn 34 and tongue injection device 40 and into a rod forming means 48. The converging horn 34 gathers and condenses the bloomed filaments transversely to the direction of the filter tow path and passes the compressed tow through the tongue injection device 40. While undergoing further compression and compaction by the rod forming means 48, the tow is wrapped by the paper web 42 which is carried simultaneously with the tow into the rod forming means 48 by an endless conveyor belt 50. The paper web 42 is formed into a substantially cylindrical configuration as it passes through the rod forming means 48. The conveyor belt 50 is driven by a plurality of guide rolls 52 and an operatively connected drive means (not shown). The formed and wrapped filter rod 54 is withdrawn from the rod forming means 48 by a pair of transport rolls 56, 58 and subsequently cut into sections 60 of desired length by a cutting apparatus 62.

According to the first embodiment of the invention, during operation of the rod-making apparatus 10, a liquid additive, such as a flavorant, from an additive supply reservoir 64 is fed by a pump 66 via a throttle valve 65 and shut-off valve 67 through a conduit 68 into a first inlet 70 of the tongue injection device 40 of the present invention. The injection of the liquid additive is preferably accompanied by the injection of a gaseous fluid, such as pressurized air, for atomizing the liquid additive for injection into the tow. If a gaseous fluid is used to atomize the liquid additive, a pressurized gas supply 72, e.g., air, is fed via a throttle valve 74 and shut-off valve 75 through a conduit 76 into a second inlet 80 of the tongue injection device 40.

Now referring to the embodiment of the invention shown in FIGS. 2–5, the tongue injection device 40 comprises a tongue portion 82, which is similar in construction and function to the tongue device of a conventional filter rod-making apparatus. The tongue portion 82 is an elongated converging channel member having a wall formed with an inverted, generally U-shaped cross-section as is well known in the art. The tongue injection device 40 is fixedly secured to the garniture 41 in a manner well known in the art.

A nozzle block 84 is integrally formed with or affixed to the tongue portion 82 adjacent the upstream end thereof. Nozzle block 84 includes a narrow streamlined portion 83 which extends downwardly into the converging channel or throat of the tongue portion 82 so as to be rigidly fixed in the path of travel of the filter tow as it is advanced through the tongue portion 82. The upstream end 85 of the nozzle block 84 is rounded and streamlined so as to minimize friction and drag between the nozzle block and the advancing tow.

A nozzle conduit 86 is formed at the lowermost extremity of the nozzle block 84 such that the longitudinal axis of the conduit 86 is substantially parallel to the longitudinal axis of the tongue portion 82. The conduit 86 comprises a blind bore formed in the nozzle block 84 with the upstream end of the bore closed and sealed by a threaded plug 88.

The upper portion 90 of the nozzle block 84 is provided with a threaded bore 92 which communicates with the nozzle conduit 86 by a passage 94. An atomizer 71 is threaded into bore 92 and carries the first and second inlets 70, 80 for a liquid additive and a pressurized gas supplied from conduits 68, 76, respectively. Atomizer 71 may be of any conventional construction suitable for atomizing the liquid additive with the pressurized gas. One such construction may be a capillary tube for introducing the liquid additive into the pressurized gas stream as described in the aforesaid U.S. Pat. No. 4,549,875.

Figure 5:
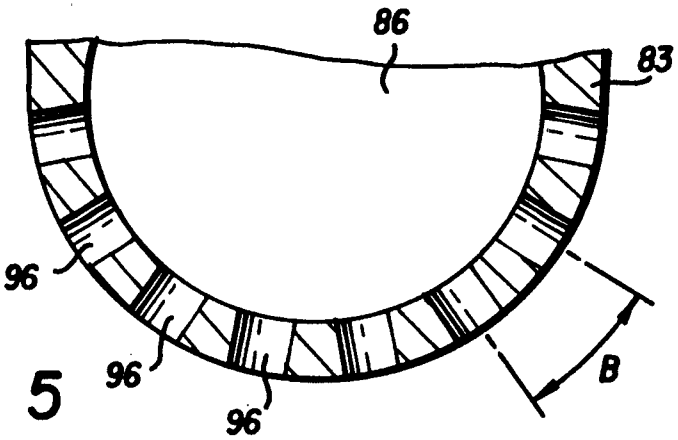
FIG. 5 is an enlarged fragmentary crosssectional view of the nozzle conduit shown in FIG. 4 taken along stepped line 5—5 and showing the angular arrangement of the feed holes about the axis of the nozzle conduit.
Figure 4:
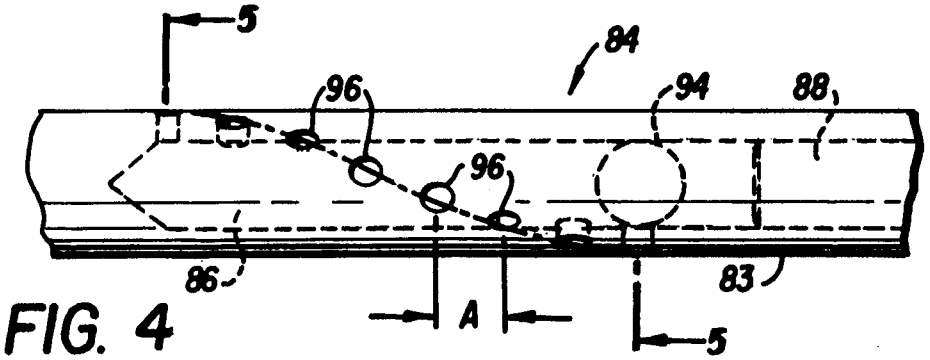
FIG. 4 is an enlarged fragmentary view, of the injection nozzle of the tongue injection device of FIG. 2 as viewed along line 4—4 and illustrating the arrangement of the feed holes and connecting supply conduit.

Referring now to FIGS. 4 and 5, the arrangement of the nozzle feed holes will be described. A plurality of feed holes 96 is spirally arrayed about the lower, rounded portion of the nozzle block 84 upstream of the junction between the nozzle conduit 86 and the passage 94. Each feed hole 96 is spaced one from the next by a longitudinal distance A. As shown in FIG. 5, eight feed holes 96 are equi-angularly spaced apart one from the next by an angular displacement B over approximately a 180° portion of the lower periphery of the nozzle block 84. In the embodiment shown, the angle B is about 22.5 degrees so that the array of feed holes 96 extends over a total arc of about 157.5 degrees between the centers of the holes at each extremity of the spiral array. In one construction according to the invention, the eight feed holes 96 each have a diameter of 0.02 inch and the distance A spacing is 0.05 inch. Alternative combinations of the number, size, spacing and arrangement of the feed holes 96 is possible within the scope of the invention. It has been found that a pressure of about 20 psi is effective for proper atomization of a liquid additive, such as a flavorant.

According to the second embodiment of the invention, a gaseous fluid, such as air, is injected from pressurized gas supply 72 via throttle valve 74, shut-off valve 75 and through conduit 76 into the second inlet 80 of the tongue injection device 40. The pump 66 is shut down so that no additive is introduced into the first inlet 70 and, preferably, shut-off valve 67 is closed to prevent any flow through conduit 68 to the tongue injection device 40. It is not necessary to use atomizer 71 in the second embodiment of the invention and the atomizer may be removed if desired. However, if the atomizer does not excessively restrict the flow of gas or air to the tongue injection device 40, it may be left in place when practicing the process of the second embodiment of the invention.

It has been found according to the process of the second embodiment that introduction of air at a pressure in the range of about 20–70 psi into the tow at or adjacent the longitudinal axis of the tow provides an additional or secondary blooming of the tow to an extent sufficient to reduce the required volumetric input of tow for a given length of filter rod manufactured. While an air pressure range of 20–70 psi has been found effective in one construction of the invention, it is contemplated that a greater or lesser pressure may be used depending, among other things, on the type of filter material being processed, the particular design of the nozzle conduit, nozzle holes, and the like.

Figure 6:
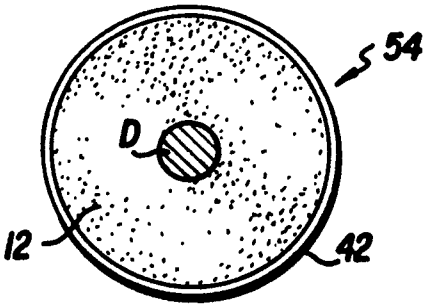
FIG. 6 is an enlarged cross-sectional view of a compressed and wrapped filter rod illustrating the location of an additive supplied to a filter tow with the tongue injection device of the present invention.
Figure 3:
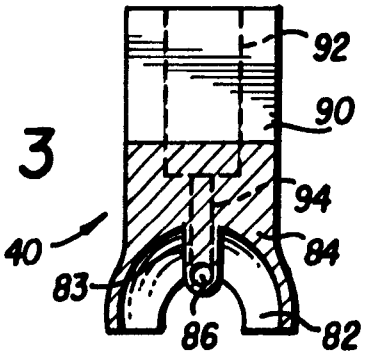
FIG. 3 is a cross-sectional view of the tongue injection device of the invention taken along line 3—3 of FIG. 2.
Figure 2:
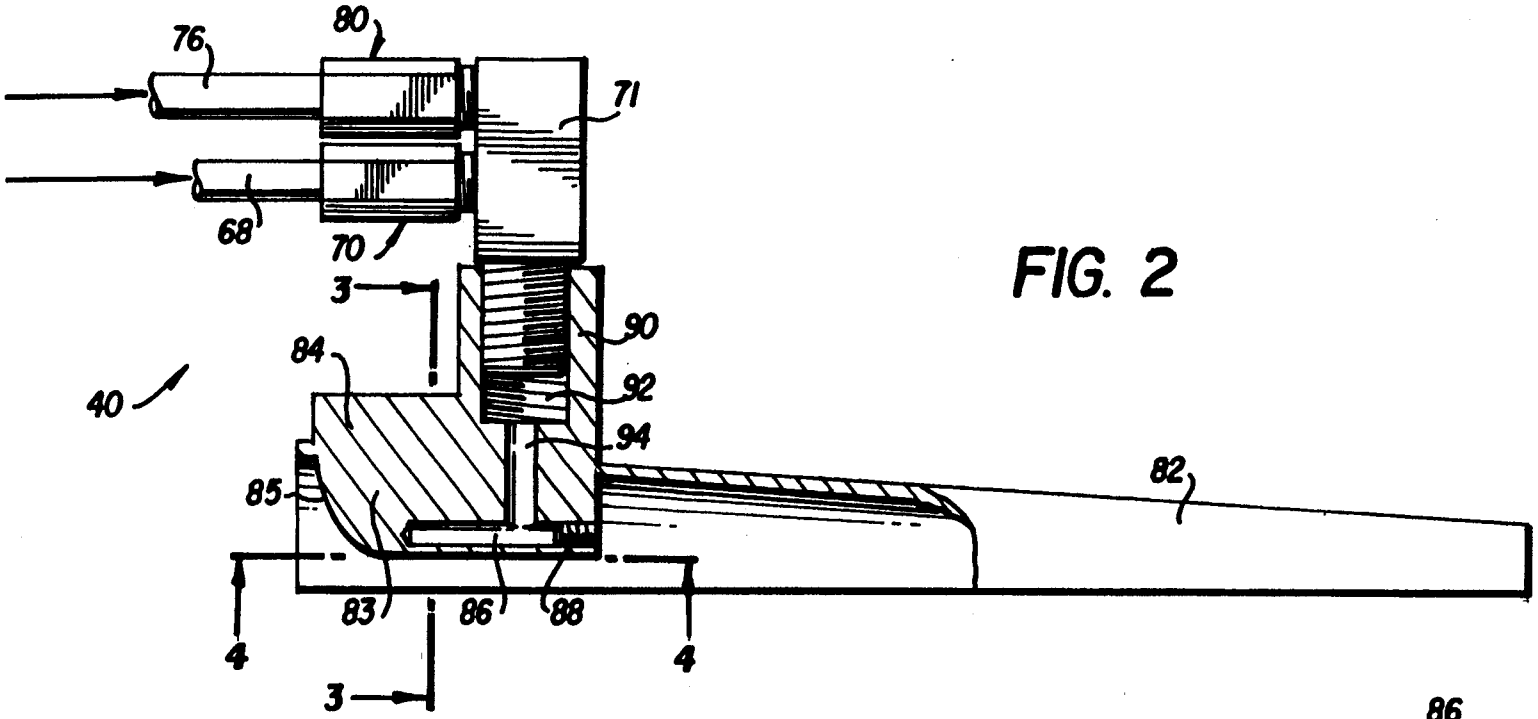
FIG. 2 is a side elevation view, partly in cross-section, of the tongue injection device of the present invention for injecting a fluid into the tow.

It should be apparent from the foregoing description that the present invention provides an improved apparatus for injecting fluids into a continuous multifilament filter tow at a precise location along or adjacent the longitudinal axis of the filter tow. FIG. 6 illustrates a cross-sectional view of the finished filter rod 54 wrapped with paper web 42. The central area D shows the location of an additive introduced into the filter tow 12 by means of the tongue injection device 40 of the present invention.

It is also contemplated within the scope of the present invention that the tongue injection device could be constructed to position an additive in any desired location relative to the longitudinal axis of the filter tow. In addition, the additive may be supplied to the filter rod intermittently or periodically by pulsing the injection pressures of the additive and the pressurized gas.

Although certain preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. Apparatus for injecting a fluid into an advancing filter tow used in the manufacture of tobacco smoke filters, comprising tongue means for converging and compressing the tow into a continuous rod-like member, said tongue means having a wall forming a converging throat through which the tow is adapted to pass along a path of travel, nozzle means rigidly affixed to said tongue means and extending into said converging throat for injecting a fluid into the tow as it travels through said converging throat, said nozzle means comprising a nozzle block rigidly affixed to the wall of said tongue means and extending radially inwardly from said wall into the throat along the path of travel of the tow, a conduit formed in said nozzle block substantially along said path, a plurality of feed holes disposed in said nozzle block and communicating said conduit with the throat of said tongue means, and means for supplying said fluid to said conduit.

2. Apparatus according to claim 1, wherein the throat of said tongue means converges from an upstream end to a downstream end thereof, said nozzle means being rigidly affixed to said tongue means at the upstream end thereof.

3. Apparatus according to claim 1, wherein said fluid supplying means comprises a source of pressurized additive and a source of pressurized gas, and an atomizer connected between said nozzle block and said fluid supplying means for atomizing the additive with the pressurized gas.

4. Apparatus according to claim 3, wherein said nozzle block includes a threaded bore for threadably receiving said atomizer.

5. Apparatus according to claim 1, wherein said tongue means comprises a wall having a generally inverted U-shaped cross-section with an open side and a closed side thereof, said nozzle block being affixed to the closed side of said wall and extending toward said open side of said wall.

6. Apparatus according to claim 1, wherein said plurality of feed holes is arranged in a spiral array.

7. Apparatus according to claim 1, wherein said nozzle block includes a streamlined portion extending into said throat, said conduit being formed in said streamlined portion.

8. Apparatus for injecting a fluid into an advancing filter tow used in the manufacture of tobacco smoke filters, comprising tongue means for converging and compressing the tow into a continuous rod-like member, said tongue means having a converging throat through which the tow is adapted to pass along an axis of travel, nozzle means rigidly affixed to said tongue means and extending into said converging throat for injecting a fluid into the tow, said nozzle means comprising a nozzle block affixed to said tongue means, a conduit formed in said nozzle block, a plurality of feed holes disposed in said nozzle block and communicating said conduit with the throat of said tongue means, means connected to said nozzle means for supplying a fluid to said nozzle means and means for connecting said fluid supplying means to said conduit, said conduit being closed at both ends thereof, said connecting means comprising a passage intersecting said conduit intermediate said closed ends thereof.

9. Apparatus according to claim 1, wherein said fluid supplying means comprises a source of a pressurized flavorant additive.

10. Apparatus according to claim 3, wherein said source of pressurized additive comprises a source of pressurized flavorant and said source of pressurized gas comprises a source of pressurized air.

11. Apparatus according to claim 1, wherein said fluid supplying means comprises a source of pressurized gas.

12. Apparatus according to claim 1, wherein said conduit has a longitudinal axis disposed substantially coincident with the axis of the path of travel of the two.

13. Apparatus for manufacturing a filter rod containing an additive for a smokable article, comprising:

means for advancing a continuous multifilament tow along a path of travel from an upstream supply of tow;

converging horn means arranged along said path of travel for converging said tow;

tongue injection means arranged downstream of said converging horn means for further converging and compressing said tow, said tongue injection means having upstream and downstream ends and comprising an alongated, generally U-shaped throat through which said tow travels, said throat converging from the upstream toward the downstream end thereof, and nozzle means rigidly affixed to the upstream end of the tongue injection means and extending into the throat for supplying the additive to the tow as it travels through the throat, said nozzle means comprising a nozzle block affixed to said tongue means, a conduit formed in said nozzle block, a plurality of feed holes disposed in said nozzle block and communicating said conduit with the throat of said tongue means, said conduit being closed at both ends thereof, said connecting means comprising a passage intersecting said conduit intermediate said closed ends thereof; and rod forming means arranged downstream of said tongue injection means for forming said tow into a filter rod having the additive disposed along a predetermined axis thereof.

14. Apparatus according to claim 1, wherein said nozzle block is integrally formed in one piece with the wall of said tongue means.

15. Apparatus according to claim 1, comprising a passage extending through the nozzle block and the wall of said throat in communication with said conduit.

16. Apparatus according to claim 15, wherein said passage extends substantially at right angles to the axis of travel of the tow.

17. Apparatus according to claim 1, wherein said conduit is formed in a radially innermost portion of said nozzle block, said portion being disposed entirely in the throat of said tongue means.

* * * * *